US006764211B2

(12) United States Patent
Eto et al.

(10) Patent No.: US 6,764,211 B2
(45) Date of Patent: Jul. 20, 2004

(54) VEHICLE HEADLAMP

(75) Inventors: Toyozo Eto, Shimizu (JP); Masayoshi Kuroda, Shimizu (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 10/383,325

(22) Filed: Mar. 7, 2003

(65) Prior Publication Data

US 2003/0179589 A1 Sep. 25, 2003

(30) Foreign Application Priority Data

Mar. 22, 2002 (JP) ..... 2002-080429

(51) Int. Cl.[7] ..... F21V 29/00
(52) U.S. Cl. ..... 362/547; 362/294; 362/373
(58) Field of Search ..... 362/294, 373, 362/547, 351

(56) References Cited

U.S. PATENT DOCUMENTS 4,931,912 A * 6/1990 Kawakami et al. ..... 362/547
5,647,659 A 7/1997 Mori
5,993,035 A * 11/1999 May et al. ..... 362/547
6,045,248 A * 4/2000 Ashizawa ..... 362/547
6,238,072 B1 * 5/2001 Eto ..... 362/539
6,497,507 B1 * 12/2002 Weber ..... 362/547
6,513,960 B2 * 2/2003 Dinant ..... 362/549
6,595,672 B2 * 7/2003 Yamaguchi ..... 362/547

FOREIGN PATENT DOCUMENTS

GB 2 298 036 8/1996

* cited by examiner

*Primary Examiner*—Thomas M. Sember
(74) *Attorney, Agent, or Firm*—Koda & Androlia

(57) ABSTRACT

A vehicle headlamp including a lamp body that has a concave portion with its front face opened, a front cover that covers the front opening of the lamp body, a reflector that is tiltably installed in the lamp body, a bulb that is installed in the reflector, and a cap-shaped shade installed so as to block the light emitted directly from the bulb and direct the light not to be irradiated. The reflector has an air ventilation hole which is formed in an area that is on the peripheral edge of a bulb mounting portion of the reflector and is on an inner side, when viewed from the front, of the outer edge of the shade.

2 Claims, 6 Drawing Sheets

VEHICLE HEADLAMP

BACKGROUND OF THE INVENTION

1. Field of the Invention

The present invention relates to a vehicle headlamp and more particularly to a vehicle headlamp that has a cap-shaped shade covering the light bulb.

2. Prior Art

In a vehicle headlamp, in order to block the light directed forward from the light bulb and the light which is difficult to control and becomes glare light, a cap-shaped shade is employed. The cap-shaped shade is provided so as to cover the front end portion of the light bulb.

As well known, the light bulb used in a vehicle headlamp becomes considerably high temperature when it is lit. The heat generated when the lamp is on is normally released by convection, radiation and the like. However, when the cap-shaped shade is used and the front end portion of the bulb is covered by shade, the heat tends to remain in an area covered by the shade, and the stored heat increases the temperature of the bulb even further. When the temperature of the light bulb becomes too high, the life of the bulb is shortened.

SUMMARY OF THE INVENTION

Accordingly, it is an object of the present invention to provide a vehicle headlamp that secures a ventilation between an area covered by the cap-shaped shade inside the reflector and the outside of the reflector, thus preventing the heat from being trapped in the area covered by the cap-shaped shade.

The above object is accomplished by a unique structure of the present for a vehicle headlamp that comprises: a lamp body which has a concave portion with its front face opened, a front cover which covers the front opening of the lamp body, a reflector which is tiltably installed in the lamp body, a bulb which is supported by the reflector, and a cap-shaped shade which blocks the light emitted directly from the bulb so that the bulb light is not directly irradiated at least forward; and in the present invention, the reflector has an air ventilation hole which is formed in an area that is on a peripheral edge of a bulb mounting portion of the reflector and is on an inner side, when viewed from the front, of the outer edge of the shade.

With this structure, heat inside the cap-shaped shade is released to the outside of the reflector through the air ventilation hole which is formed so as to correspond to the inside area of the cap-shaped shade. Heat is thus not trapped inside the cap-shaped shade, the temperature of the bulb is prevented from becoming too high (or higher than required), and the life of the bulb is not shortened by the heat inside the cap-shaped shade.

DETAILED DESCRIPTION OF THE INVENTION

Figure 1:
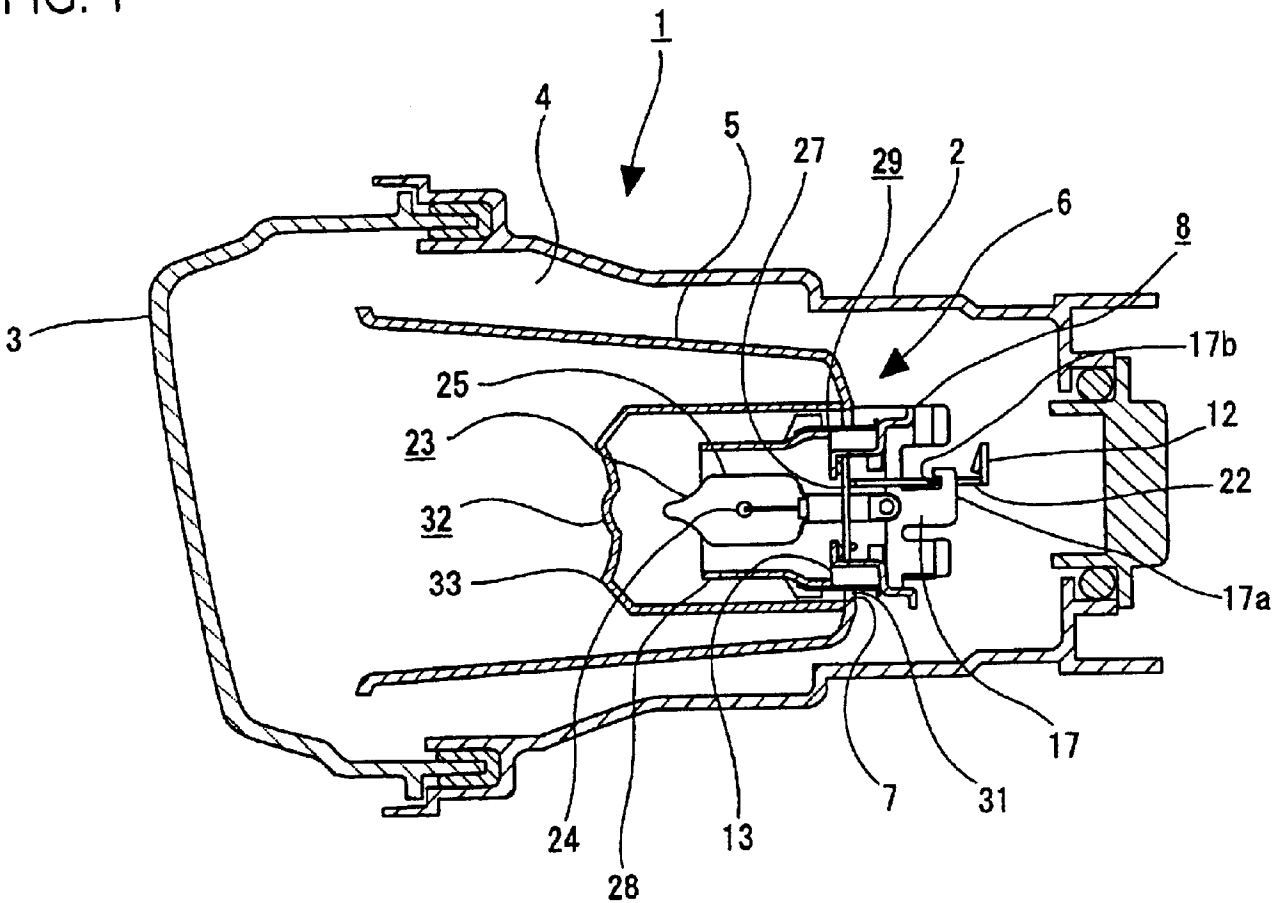
FIG. 1 shows in cross-section the vehicle headlamp according to one embodiment of the present invention.

Embodiments of the vehicle headlamp according to the present invention will be described below with reference to the accompanying drawings. In the embodiments described below and shown in the drawings, the present invention is applied to an auxiliary headlamp for an automobile such as a fog lamp.

The vehicle headlamp 1 is comprised of a lamp body 2, a translucent front cover 3, and a reflector 5. The lamp body 2 has a concave area with its front face opened. A lamp space 4 is defined by the lamp body 2 and the translucent front cover 3 that covers the front opening of the lamp body 2, and the reflector 5 is installed in the lamp space 4 in a tiltable manner.

The reflector 5 includes a bulb mounting portion 6 that is at substantially the center of the rear portion of the reflector 5. The bulb mounting portion 6 is comprised of a substantially circular reflector opening 7, which is formed in the reflector 5, and a socket base 8, which is attached to the reflector 5 so as to cover the reflector opening 7 except for a peripheral area of the opening 7.

At positions along the edge of the circular reflector opening 7 on the rear face of the reflector 5, two pairs of mounting bosses 9 and 10 are formed in a protruding manner at diametrically opposed positions.

The socket base 8 includes a cylindrical section 11, which is formed by pressing a metal sheet into a cylindrical shape, and a pressing spring 12, which is attached to this cylindrical section 11. The cylindrical section 11 has a length that is short in the axial direction than its diameter. The rear end portion 11*a* of the cylindrical section 11 has a diameter that is slightly larger than the diameter of a front end portion 11*b*, which is in front of the rear end portion 11*a*. A front portion 13 is formed so as to cover the entire front face of the cylindrical section 11, and a substantially rectangular insertion hole 13*a* is formed in this front portion 13. At opposed positions which are continuous to the front portion 13 of the front end portion 11*b* of the cylindrical section 11, positioning protrusions 14*a* and 14*b* are formed so as to protrude in an embossing manner and to come close to each other. In addition, at positions of the front end portion 11*b* of the cylindrical section 11 which are close to the rear end portion 11*a*, a plurality of engagement openings 15 are formed at certain intervals in the circumferential direction.

From portions which are positioned on opposite sides of the rear end of the cylindrical section 11, mounting legs 16 extend so as to protrude rearward. Rear end portions of the mounting legs 16 are bent in opposite directions (or bent outward) so as to form mounting pieces 16*a*. In the mounting pieces 16*a*, screw insertion holes 16*b* are formed.

Also, at one of two positions which are diametrically opposite and are other than the mounting legs 16 in the rear end of the cylindrical section 11, an engagement piece 17 is provided so as to protrude rearward; and at another one of such positions, a spring supporter 18 is formed.

The rear end portion 17*a* of the engagement piece 17 is bent so as to extend along the substantially circumferential direction. The engagement piece 17 thus forms an L-shape. An engagement concave portion 17*b* is formed on the front edge of the rear end portion 17*a*.

The pressing spring 12 is formed by a wire spring, and two pressing arms 19 and 20 protrude from both ends of the intermediate portion 21 of the pressing spring 12 and extend in the same direction. The tip end of the pressing arm 19 has an engagement arm 22 that is substantially in a V-shape with respect to the pressing arm 19. The intermediate portion 21 of the pressing spring 12 is attached to the root area of the spring supporter 18 in the inner surface of the cylindrical section 11, and the spring supporter 18 is bent so as to make a contact with an inner side of the cylindrical section 11. The pressing spring 12 is, at its intermediate portion 21, thus rotatably supported by the spring supporter 18.

A bulb 23 is comprised of a glass bulb 25 having a filament 24 inside and a base portion 26; and a flange 27 which is substantially circular when viewed from the longitudinal direction of the bulb 23 protrudes outwardly between the glass bulb 25 and the base portion 26. At diametrically opposite positions on its outer edge, the flange 27 has engagement notches 27*a* and 27*b*.

Figure 2:
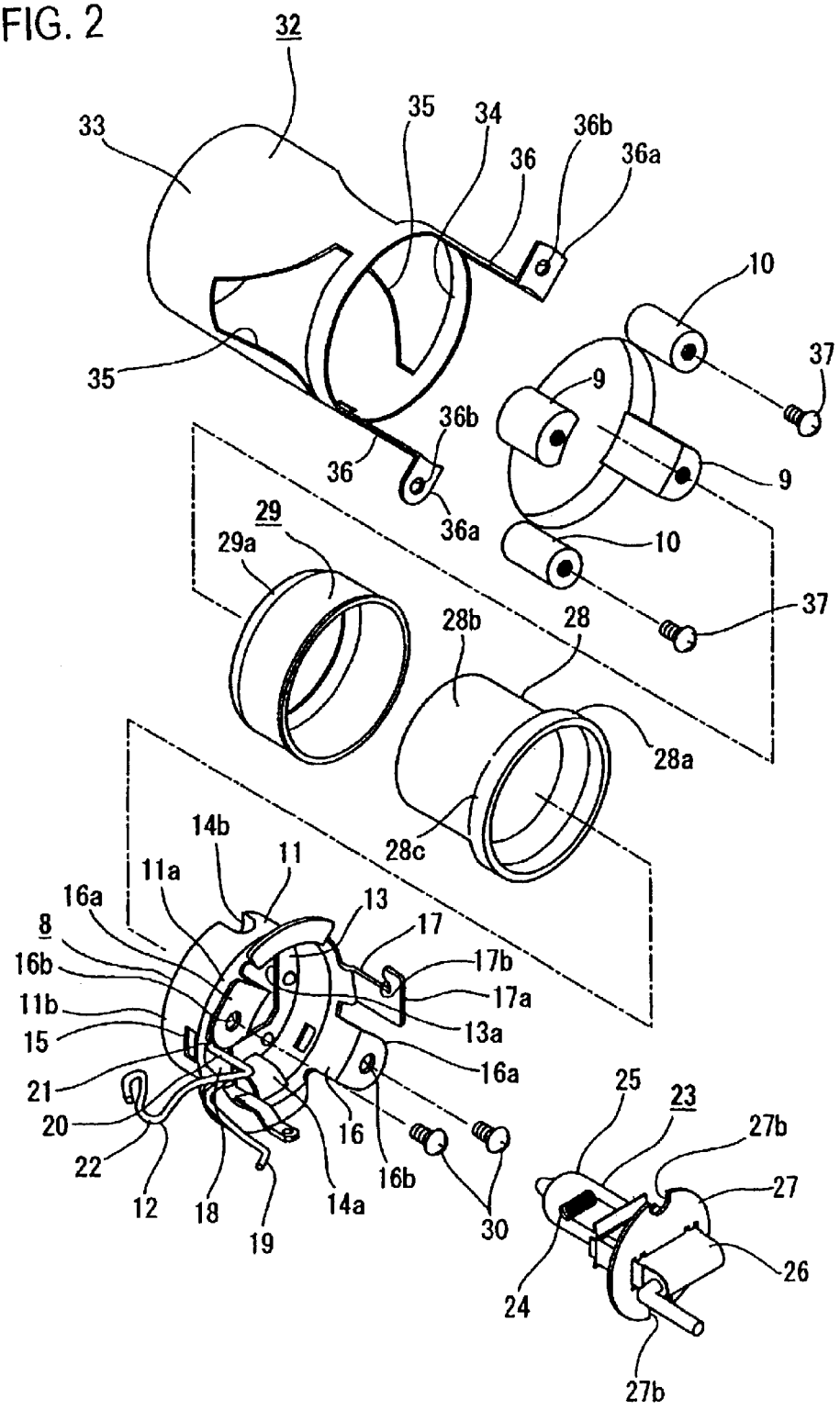
FIG. 2 is an exploded perspective view of the main portion of the vehicle headlamp.
Figure 3:
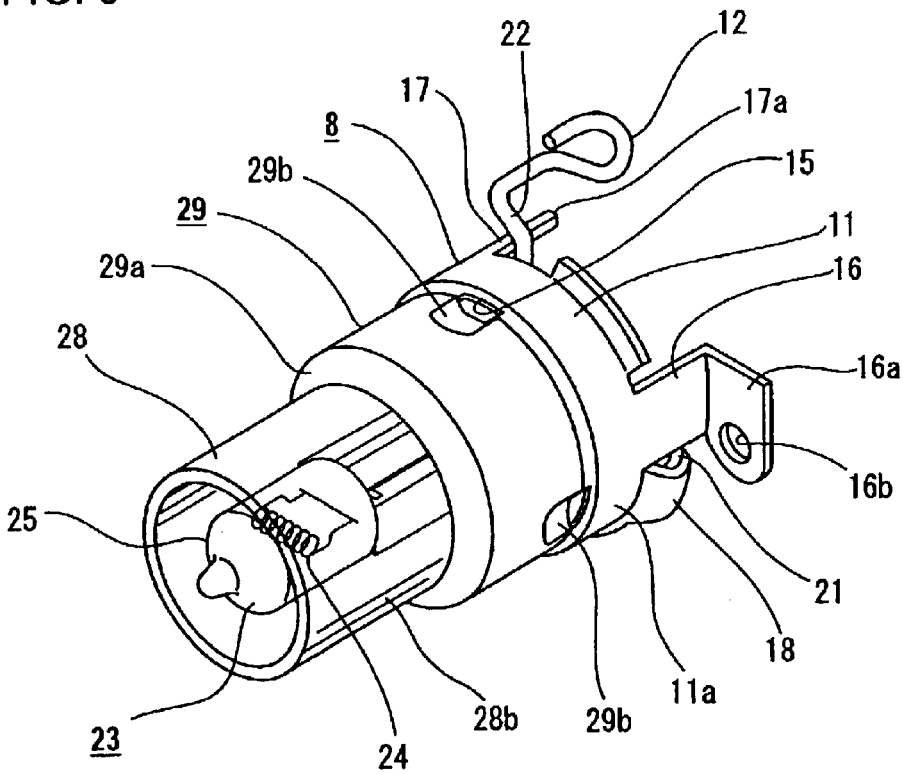
FIG. 3 is a perspective view of the main portion.
Figure 4:
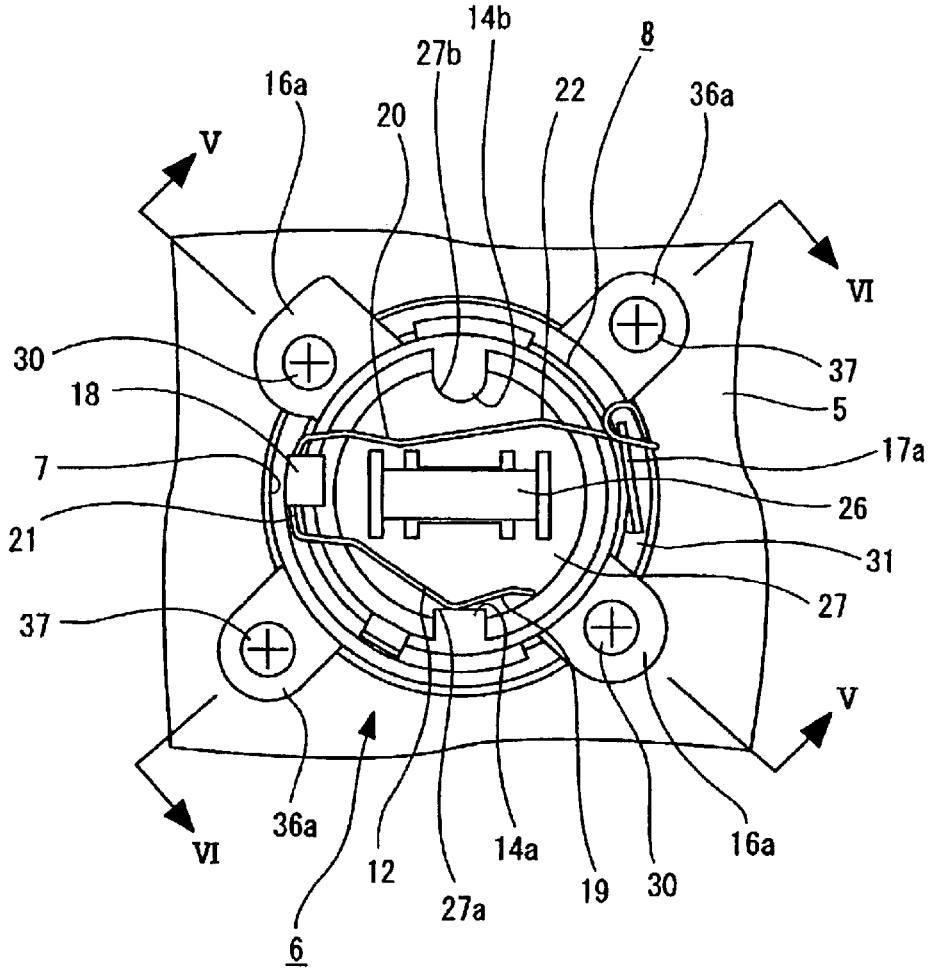
FIG. 4 is a rear view of the main portion.
Figure 5:
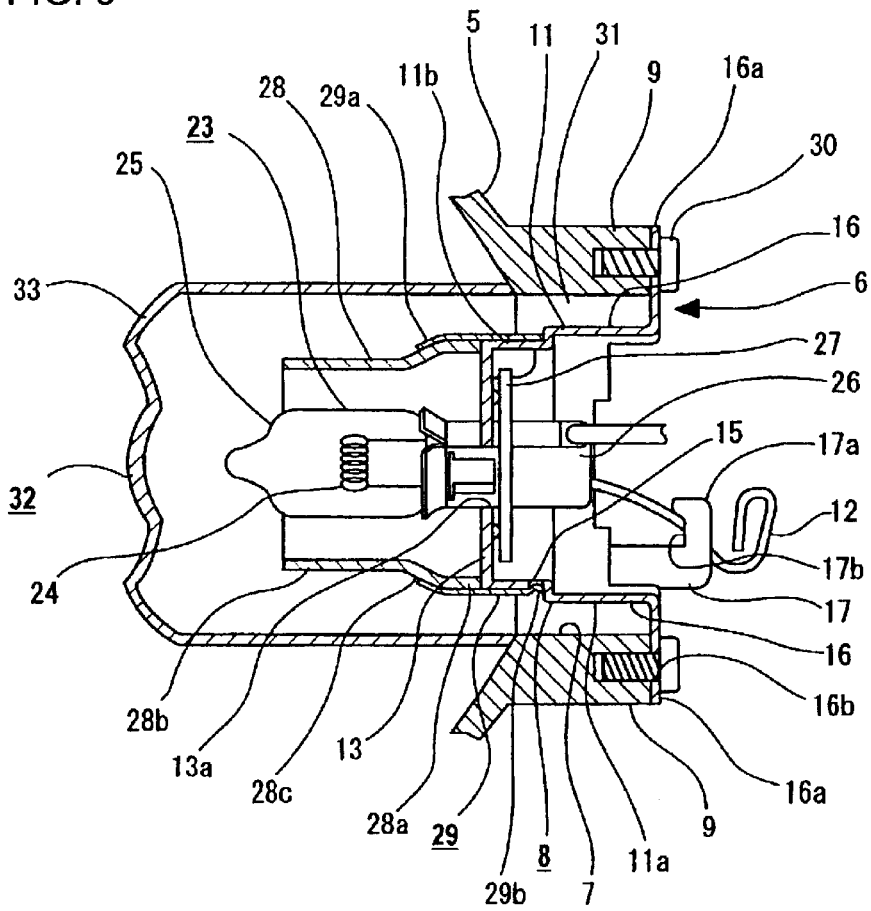
FIG. 5 is a sectional view taken along the line V—V in FIG. 4.
Figure 6:
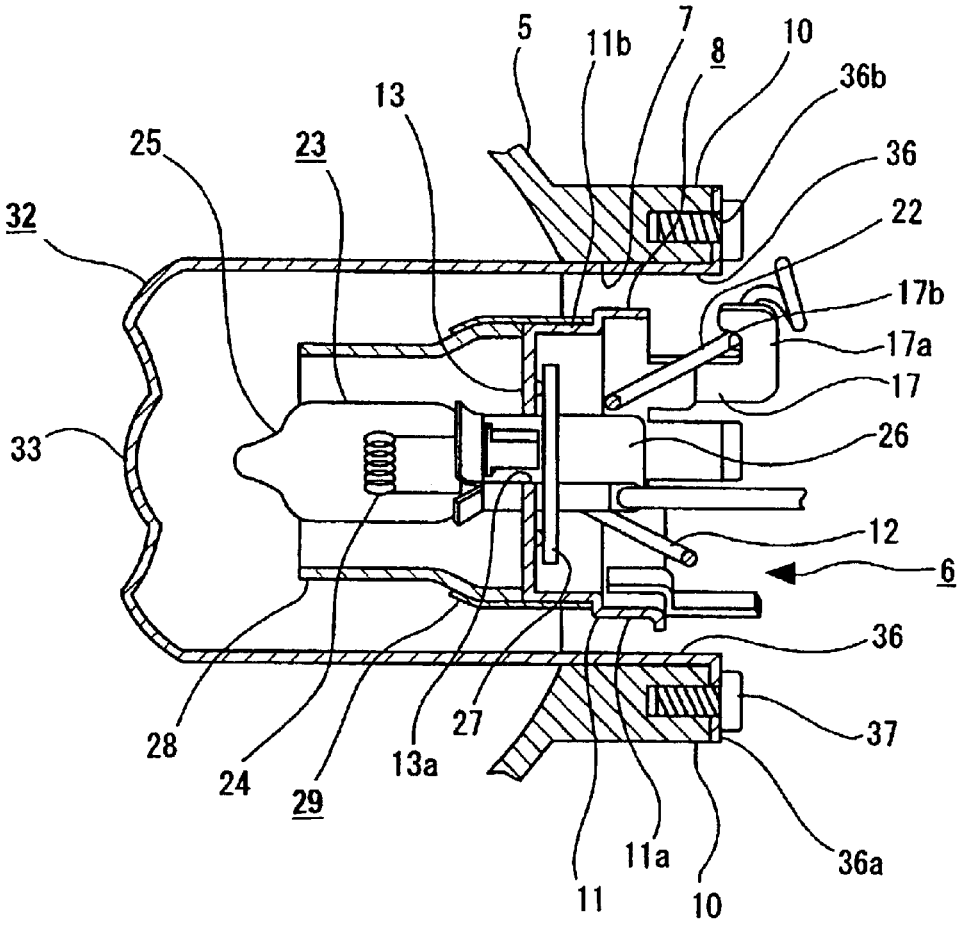
FIG. 6 is a sectional view taken along the line VI—VI in FIG. 4.

The bulb 23 is attached to the socket based 8. In particular, with the pressing spring 12 rotated rearward (shown in FIG. 2), the glass bulb 25 of the bulb 23 is inserted forward through the insertion hole 13*a* formed in the front portion 13 of the socket base 8. At this point, since the engagement notches 27*a* and 27*b* of the bulb 23 are aligned with the positioning protrusions 14*a* and 14*b* of the socket base 8, the glass bulb 25 protrudes forward from the front portion 13. The flange 27 is brought to contact with the rear face of the front portion 13 of the socket base 8 with the engagement notches 27*a* and 27*b* being engaged with the positioning protrusions 14*a* and 14*b* and positioned around the axis of the bulb 23 by the socket base 8. Then, the pressing spring 12 is rotated forward such that the front ends of the two pressing arms 19 and 20 contact with the positions on both sides of the base portion 26 on the rear surface of the flange 27 of the bulb 23. Further, a portion which is closer to the tip end of the engagement arm 22 is locked at the engagement concave portion 17*b* of the engagement piece 17 of the socket base 8 while bending the engagement arm 22 forward (see FIGS. 3 and 4). As a result, the pressing arms 19 and 20 are elastically put in contact with the rear surface of the flange 27 of the bulb 23, and the bulb 23 is supported or held by the socket base 8.

A glove 28, which is colored, is held by the socket base 8. The colored glove 28 is formed in a substantially cylindrical form using a colored-transparent material. The rear end portion 28*a* of the colored glove 28 is formed so that its diameter is slightly larger than the diameter of the front side portion 28*b*. The diameter of the portion (intermediate portion) 28*c* between the rear end portion 28*a* and the front side portion 28*b* gradually changes (so as to become larger) from the front side portion 28*b* toward the rear end portion 28*a*. The vehicle headlamp 1 of the shown embodiment is a fog lamp for an automobile as described above, and thus the colored glove 28 is yellow colored-transparent. Accordingly, when the present invention is applied to a lamp other than a fog lamp, the colored glove 28 is not necessary; and even when the colored glove 28 is necessary, it may be colored-transparent in a color other than yellow. In some cases, the glove is not colored-transparent, and a membrane that has a permeability such as an infrared permeable membrane can be formed in the glove.

The colored glove 28 is attached to the socket base 8 using a tightening ring 29. The tightening ring 29 is formed from a metal plate and in a cylindrical shape whose length is shorter in the axial direction than in the diametrical direction. The front end portion 29*a* is tapered so that the diameter gradually becomes smaller toward the front end. The internal diameter of a portion of the tightening ring 29 except for the front portion 29*a* is equal to the external diameter of the rear end portion 28*a* of the colored glove 28. The inner face of the front end portion 29*a* of the tightening ring 29 is shaped so that it fits an outer face of the intermediate portion 28*c* of the colored glove 28.

The tightening ring 29 is fitted on the colored glove 28 from the front side of the colored glove 28 so that the front end portion 29*a* comes into contact with the intermediate portion 28*c* of the colored glove 28. In this state, the tightening ring 29 is externally fitted on the cylindrical section 11 of the socket base 8. Accordingly, with the rear end of the colored glove 28 being in contact with the front face of the front portion 13 of the cylindrical section 11 of the socket base 8, the rear end edge of the tightening ring 29 is positioned so as to cover most of the engagement openings 15 of the cylindrical section 11. Then, the portions 29*b* which are facing the engagement openings 15 on the rear end edge of the tightening ring 29 are swaged so as to be pushed into the engagement openings 15. The tightening ring 29 is thus attached to the socket base 8, and the colored glove 28 is held by the socket base 8 by the tightening ring 29. The colored glove 28 is positioned so as to surround the periphery of the glass bulb 25 of the bulb 23 which is held in the socket base 8.

The socket base 8 is installed in the reflector 5 when the socket base 8 is inserted into the reflector opening 7 of the reflector 7 from the back of the reflector 7 and the mounting pieces 16*a* of the mounting legs 16 are fixed to the mounting bosses 9, which protrude from the edge portion of the reflector opening 7, by screws 30 that are inserted into the screw insertion holes 16*b* of the mounting pieces 16*a*. Then, as described above, with the socket base 8 attached to the reflector 5, a ring-shaped clearance is formed between the cylindrical section 11 of the socket base 8 and the edge of the reflector opening 7 of the reflector 5, and such a clearance becomes the ring-shaped ventilation hole 31 which provides communication between the inside and outside of the reflector 5.

A cap-shaped shade 32 is provided in the reflector 5. More specifically, the cap-shaped shade 32 is disposed so as to cover the front end portion of the bulb 23 which is held in the reflector 5 via the socket base 8 such that the direct light from the bulb 23 is not irradiated through the front cover 3. The shade 32 has such a shape, as best seen from FIG. 2, that the front end of a cylindrical section is closed and notched holes 35 are formed in both side portions between the front side portion 33 and a rear end portion 34. The front side portion 33 makes a cap portion, the rear end portion 34 makes a ring portion, and the right and left notched holes 35 make light passing openings. The diameter of the ring portion 34 is equal to or slightly larger than the diameter of the reflector opening 7 of the reflector 5. Mounting legs 36 are provided on the rear end portion (or the ring portion) 34 so as to protrude rearward from portions which are diametrically opposite from each other. The rear end portions 36*a* of the mounting legs 36 make mounting pieces, and screw insertion holes 36*b* are formed in the mounting pieces 36*a*.

The mounting legs 36 of the shade 32 are inserted through the reflector opening 7 of the reflector 5 from the front side of the reflector 5. The mounting pieces 36*a* of the mounting legs 36 are provided so as to positionally correspond to the mounting bosses 10 (which protrude from the edge portion of the reflector opening 7 on the rear face of the reflector 5) where the ring portion 34 substantially contacts the edge of the reflector opening 7. Then, the mounting pieces 36*a* of the amounting legs 36 are bent outward with respect to the other portion of the shade 32 so as to overlap with the rear face of the mounting bosses 10. Then, screws 37 are inserted into the mounting bosses 10 through the screw insertion holes

36*b* of the mounting pieces 16*a* and fixed to the mounting bosses 10. The shade 32 is thus attached to the reflector 5, and the cap portion 33 of the shade 32 is positioned so as to cover the front end portion of the bulb 23.

In the above vehicle headlamp 1, the light radiated from the filament 24 of the bulb 23 is colored when passing through the colored glove 28 (the light is colored in yellow in the embodiment), passes through notched holes (light passing opening) 35 of the shade 32, is directed to the reflector 5, is reflected by the reflector 5, passes through the front cover 3 and is radiated forward.

In the vehicle headlamp 1, the front end portion of the bulb 23 is covered by the cap portion 33 of the shade 32, and thus heat can remain in the space covered by the shade 32. However, since the air ventilation hole 31 is formed inside the area which is covered by the shade 32 when viewed from the front, the air outside the reflector 5 easily flows into the space covered by the shade 32 through the air ventilation hole 31. As a result, the temperature in the space covered by the shade 32 is prevented from being abnormally increased. Accordingly, the temperature of the bulb 23 does not become abnormally high, and the life of the bulb 23 is prevented from being shortened.

In addition, the air ventilation hole 31 is formed by way of using a difference in shape between the reflector opening 7, which is provided in the reflector 5 for attaching the socket base 8, and the socket base 8. Accordingly, it is not necessary to specially form an air ventilation opening that allows the space covered by the shade 32 to communicate with the outside. Thus, the headlamp of the present invention is simple in structure and suppresses the increase in the manufacturing cost.

The air ventilation hole 31 is positioned along the inside of the ring portion 34 of the shade 32. Accordingly, the air ventilation hole 31 is inconspicuous when the lamp is seen from outside, which makes the appearance of the lamp attractive.

When the colored glove 28 that surrounds the bulb 23 is provided as in the above vehicle headlamp 1, heat tends to remain more inside the colored glove 28; and thus the air ventilation hole 31 is further effective and can let the heated air out of the lamp body. Needless to say, the structure of the present invention is effective also for a vehicle headlamp that does not have a colored glove, and the present invention has an effect of not shortening the life of the light bulb.

It should be understood that the form and the structure of each element shown in the above embodiment are merely examples of embodying the present invention, and the technical scope of the present invention must not be construed in a limited manner.

As is clear from the above, the present invention is for a vehicle headlamp that includes a lamp body that has a concave portion with its front face opened, a front cover that covers the front opening of the lamp body, a reflector that is tiltably installed in the lamp body, a bulb that is held in the reflector, and a cap-shaped shade that blocks the light emitted directly from the bulb so that the light is not irradiated at least forward; and in the present invention, the reflector has an air ventilation hole which is formed in an area that is on a peripheral edge of the bulb mounting portion of the reflector and is on an inner side, when viewed from the front, of the outer edge of the shade.

Accordingly, heat inside the cap-shaped shade can easily go out to the outside of the reflector through the air ventilation hole which is formed so as to correspond to the inside area of the cap-shaped shade. The heat is thus prevented from being trapped inside the cap-shaped shade, and the temperature of the bulb is prevented from becoming too high or higher than required; as a result, the life of the bulb is prevented from being shortened.

Furthermore, in the present invention, the bulb mounting portion of the reflector is formed with a reflector opening and a socket base which is attached to the reflector with an empty space between the edge of the reflector opening and the socket base, the air ventilation hole is between the peripheral edge of the socket base and the edge of the reflector opening, and the bulb is removably attached to the socket base. Accordingly, it is not necessary to specially form an air ventilation means that allows the space covered by the shade to communicate with the outside. Thus, the lamp is simple in structure, and it is possible to suppress an increase in the manufacturing cost.

Furthermore, in the vehicle headlamp of the present invention, the shade has a ring portion that extends in a ring shape at a portion near the bulb mounting portion of the reflector, and the air ventilation hole is formed along, when viewed from the front, the inside of the ring portion. Accordingly, the air ventilation hole inconspicuous from the outside, and the lamp has an attractive appearance.

What is claimed is:

1. A vehicle headlamp comprising:

a lamp body which has a concave portion whose front face is open, a front cover which covers the front opening of said lamp body, a reflector which is tiltably installed in said lamp body, a bulb which is held in said reflector, and a cap-shaped shade which is provided so as to block light emitted directly from said bulb and prevents said light from being irradiated at learnt forward, and wherein said reflector is provided with an air ventilation hole formed in an area which is on a peripheral edge of a bulb mounting portion of said reflector and is on an inner side of an outer edge of said shade, said bulb mounting portion of said reflector comprised a reflector opening and a socket base which is attached to said reflector with a clearance between an edge of said reflector opening and said socket base, said air ventilation bole is formed between a peripheral edge of said socket base and said edge of said reflector opening, and said bulb is removably attached to said socket base.

2. The vehicle headlamp according to claim 1, wherein said shade includes a ring portion that extends in a ring shape at a portion adjacent to said bulb mounting portion of said reflector, and said air ventilation hole is formed along an inside of said ring portion.

* * * * *